US007842176B2

(12) United States Patent
Liao

(10) Patent No.: US 7,842,176 B2
(45) Date of Patent: Nov. 30, 2010

(54) METHOD FOR HORIZONTALLY ELECTROPLATING, ELECTRO DEPOSITION AND ELECTROLESS-PLATING THIN FILM ON SUBSTRATE

(76) Inventor: Yen-Chen Liao, 235 Chung-Ho Box 8-24, Taipei (TW)

( * ) Notice: Subject to any disclaimer, the term of this patent is extended or adjusted under 35 U.S.C. 154(b) by 1118 days.

(21) Appl. No.: 11/487,122

(22) Filed: Jul. 17, 2006

(65) Prior Publication Data

US 2008/0011611 A1 Jan. 17, 2008

(51) Int. Cl.
*C25D 5/00* (2006.01)

(52) U.S. Cl. ..... 205/137; 205/148

(58) Field of Classification Search ..... 205/118, 205/123, 157, 186, 137, 148, 152; 204/198
See application file for complete search history.

(56) References Cited

U.S. PATENT DOCUMENTS 4,120,771 A * 10/1978 Dewallens ..... 204/225
5,368,715 A * 11/1994 Hurley et al. ..... 205/82
5,853,559 A * 12/1998 Tamaki et al. ..... 205/157
6,024,856 A * 2/2000 Haydu et al. ..... 205/84
6,140,234 A * 10/2000 Uzoh et al. ..... 438/678
6,153,064 A * 11/2000 Condra et al. ..... 204/198
6,254,760 B1 * 7/2001 Shen et al. ..... 205/335

* cited by examiner

*Primary Examiner*—Luan V Van

(57) ABSTRACT

A method for horizontally electroplating or electro deposition a thin film on a substrate comprises the steps of transferring and positioning a substrate on a substrate supporter; the substrate being positioned approximately horizontally; moving a plurality of stop plates to enclose horizontal edges of the substrate so as to form with an enclosure around an edge of the substrate; moving a first electrode to be in contact with a portion of the substrate; the portion being a non-wired area; moving a second electrode to be above and not in contact with the substrate; wherein the second electrode has a polarity opposite to that of the first electrode; and filling electroplating liquid into the enclosure formed by the stop plates so as to be in contact with the second electrode above the substrate for electroplating or electro deposition.

18 Claims, 6 Drawing Sheets

METHOD FOR HORIZONTALLY ELECTROPLATING, ELECTRO DEPOSITION AND ELECTROLESS-PLATING THIN FILM ON SUBSTRATE

FIELD OF THE INVENTION

The present invention relates to technologies of electroplate, electro deposition and electroless-plating, and in particular to a method for horizontally electroplating or electro deposition or electroless-plating a thin film on a substrate, wherein the substrate is arranged approximately horizontally on a supporter. A plurality of stop plates encloses the edge of the substrate so as to form an enclosure. The electroplating liquid is cyclically filled into the enclosure so as to form a uniform film upon the substrate. The substrate is in contact with one electrode so as to avoid the hurt of the rollers to the substrate. In electroless-plating method, no electrode is necessary.

BACKGROUND OF THE INVENTION

In the present invention, the electroplating means the electroplating of metal film and the electro deposition means the coating of organic electric material film, such as coating of color filter dyes, pigments, or conductive photo resistive material.

In general manufacturing process of flat displays or semiconductors, a conductive thin film is formed on a substrate (silicon wafer, glass or plastic, etc.) by for example vacuum electroplating. The material of the thin film is selected from aluminum, molybdenum, chromium, copper, and other metals or the alloys of the metals. In industrial applications, electroplating or electroless-plating is used to electroplate metals (such as copper, nickel, gold and silver) to industrial products so as to form decorations. The electroplating material is formed with a protection layer, or a decorating layer or layers with other properties (such as a circuit). In the prior art plasma vapor deposition vacuum electroplating, referring to FIGS. 1 and 2, a substrate is transferred to a chamber. Then, the chamber is vacuumed and the voltage and airflow of the chamber are controlled so as to generate an ion target. Then the atoms on the surface of the target are ejected out to expand and deposit on the substrate. However the equipments for vacuuming are expensive and are energy-consumed. Especially, the cost of large-scale substrate is very high. In the prior art, vertical and horizontal electroplating are used. In vertical electroplating, the fixedness of hanging of the substrate arrangement of the electrodes will cause that the operation time is too long and the electroplating layers are not uniform. The electroplating of large scale substrate is very difficult. Thereby in manufacturing, the substrate must be arranged to a vertical position from a horizontal position. It makes a trouble in operation. For using in roller type horizontal electroplating, when it is used in semiconductor or a flat display, it induces damages to the substrate and the film or generates non-uniform films in electroplating, or induce damages to the dyes of the conductive pigments, dyes, conductive photo resistance material in electro deposition due to the scales of the substrates, thickness of the films, and the endurance of the substrates.

Thereby there is an eager demand for a novel method which can improve the defect in the prior art horizontal electroplating.

SUMMARY OF THE INVENTION

Accordingly, the object of the present invention is to provide a method for horizontally electroplating or electro deposition or electroless-plating a thin film on a substrate, wherein the substrate is arranged approximately horizontally on a supporter. A plurality of stop plates encloses the edge of the substrate so as to form an enclosure. The electroplating liquid is cyclically filled into the enclosure so as to form an uniform film upon the substrate. The substrate is in contact with one electrode so as to cancel the hurt of the rollers to the substrate. In electroless-plating method, no electrode is necessary.

To achieve above objects, the present invention provides a method for horizontally electroplating or electro deposition thin film on a substrate. The method comprises the steps of transferring and positioning a substrate on a substrate supporter; the substrate being positioned approximately horizontally; moving a plurality of stop plates to enclose a horizontal edges of the substrate so as to form with an enclosure around an edge of the substrate; moving a first electrode to be in contact with a portion of the substrate; the portion being a non-wired area; moving a second electrode to be above and not in contact with the substrate; wherein the second electrode has a polarity opposite to that of the first electrode; and filling electroplating liquid into the enclosure formed by the stop plates so as to be in contact with the second electrode above the substrate 301 for electroplating or electro deposition.

Furthermore, the present invention provides a method for electroless plating on a substrate. The method comprises the steps of transferring and positioning a substrate on a substrate supporter; the substrate being positioned approximately horizontally; moving a plurality of stop plates to enclose a horizontal edges of the substrate so as to form with an enclosure around an edge of the substrate; filling substrate activation liquid into the enclosure for activating the substrate; filling an electroless plate liquid into the enclosure to be in contact with the substrate so as to perform an electroless plate process.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
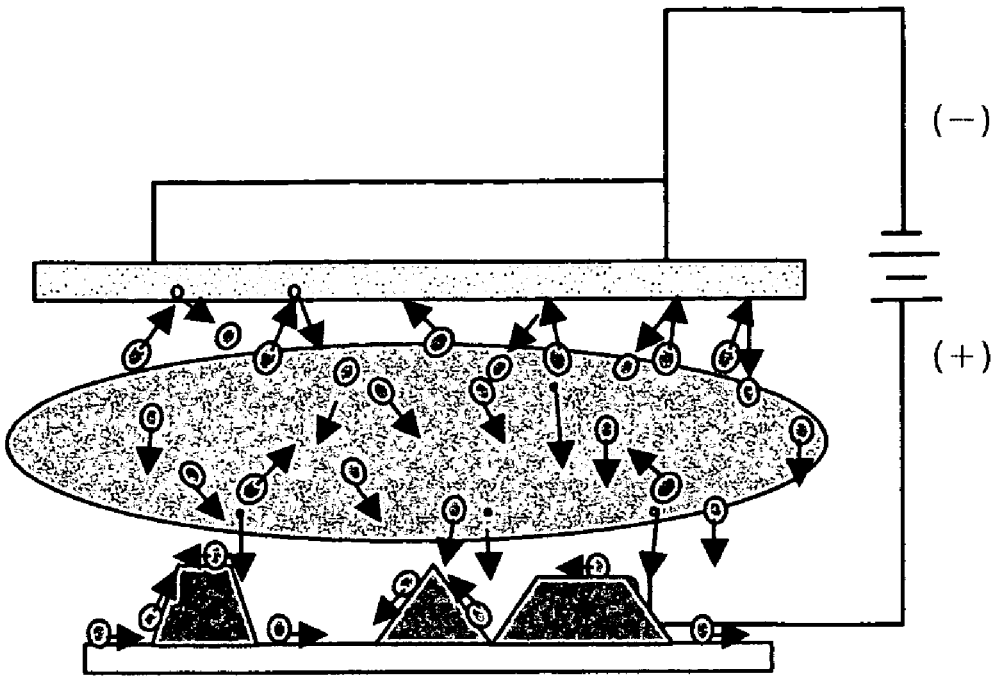
FIG. 1 shows the prior art vacuum plasma deposition process.
Figure 2:
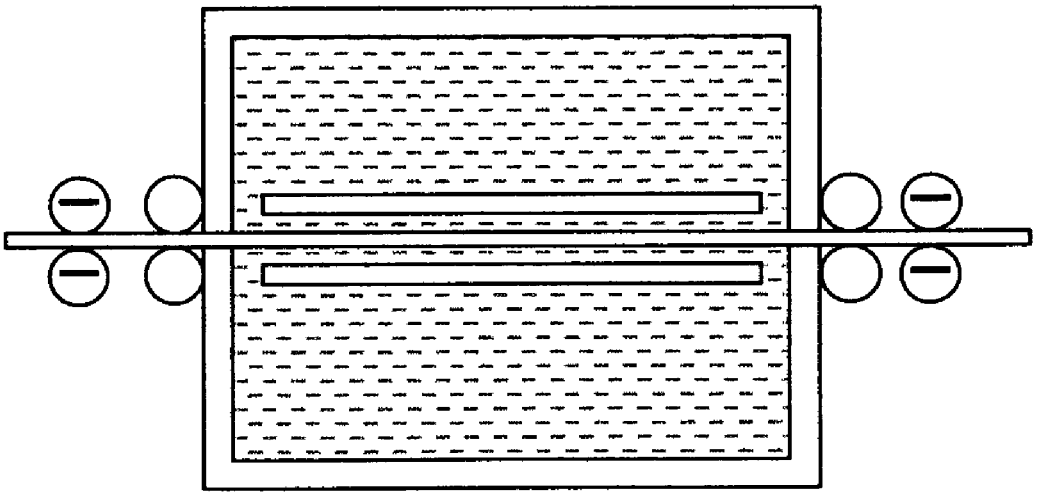
FIG. 2 shows the prior art horizontal electroplate process.
Figure 3A:
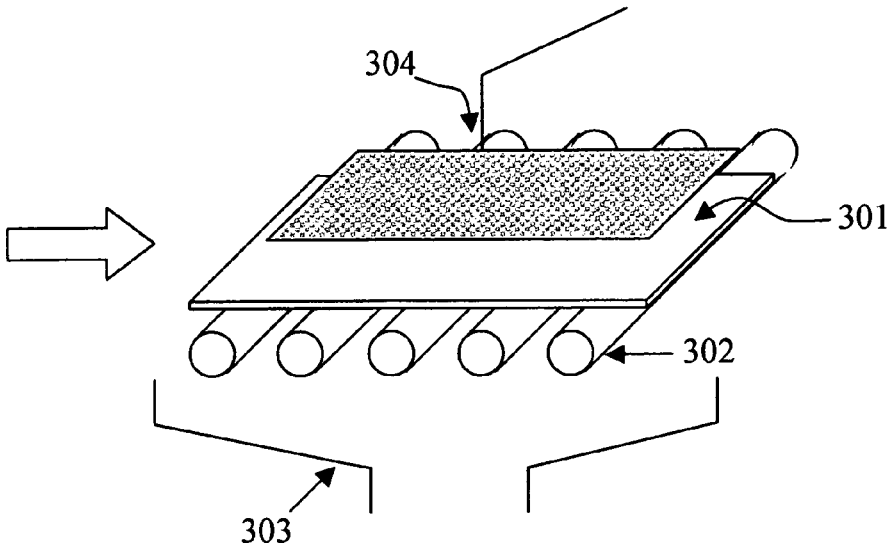
FIGS. 3A to 3C are lateral views showing the different processes of the preferred embodiment of the present invention.
Figure 3B:
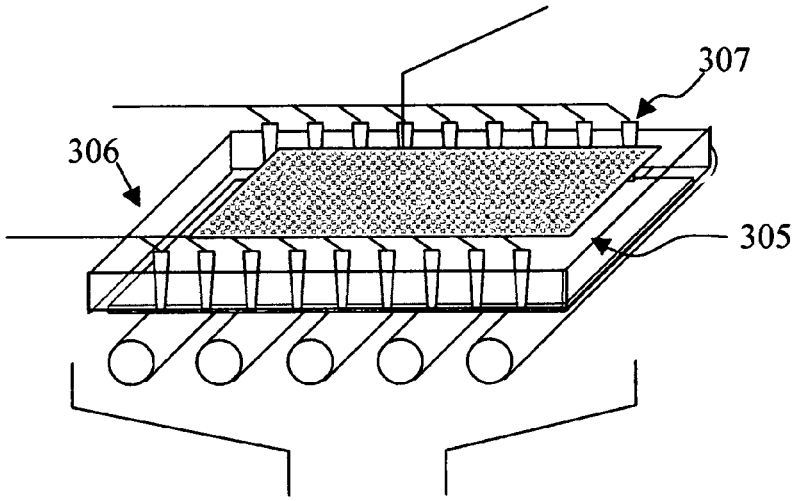
Figure 3C:
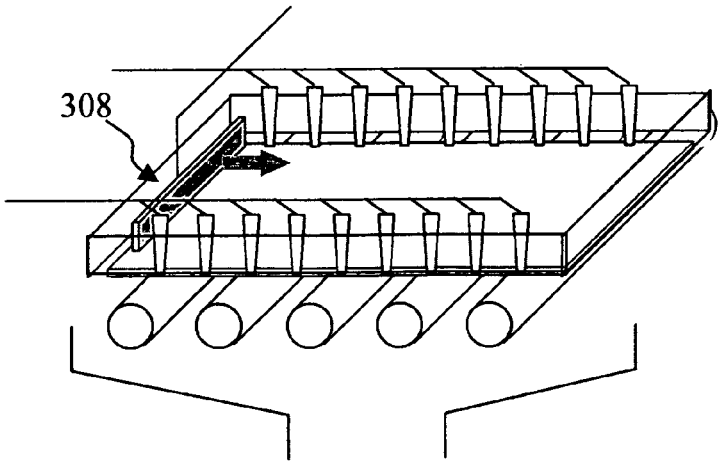
Figure 9:
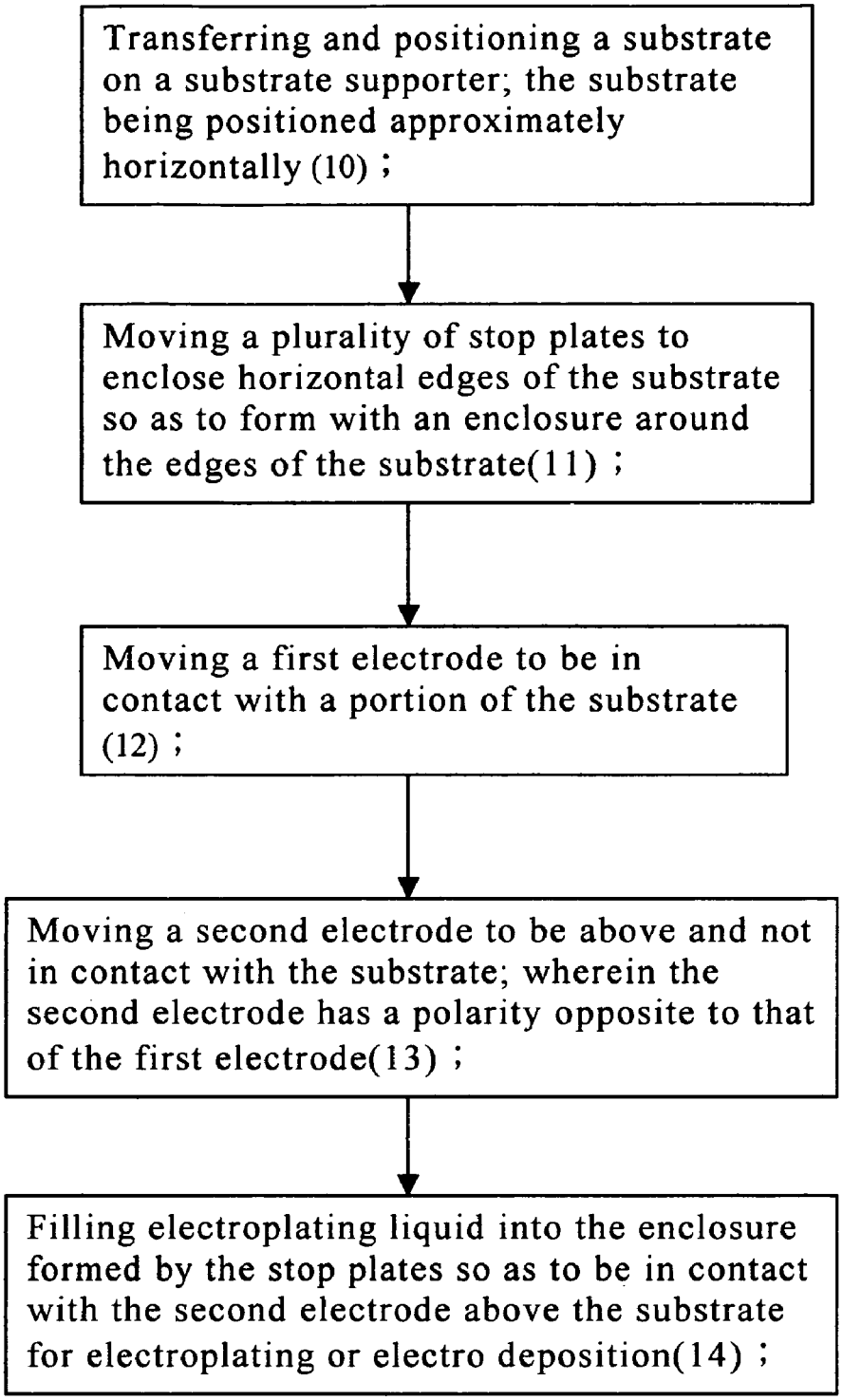
FIG. 9 shows the flow diagram of the present invention.

Referring to FIGS. 3(A) to 3(C) and the flow diagram in FIG. 9, in the present invention, firstly, a substrate 301 is transferred to and positioned on a substrate supporter 302 through at least one roller or a robot arm (not shown). The substrate 301 is positioned approximately horizontally. In this embodiment, the substrate supporter 302 is a plurality of rollers (step 10), but it is not used to confine the scope of the present invention.

After positioned, a plurality of stop plates 306 are moved to enclose a horizontal edges of the substrate 301 so as to form with an enclosure around the edge of the substrate 301 (step 11). In the present invention, the stop plates 306 are made of rigid and elastic material.

A first electrode 307 is moved to be in contact with a portion of the substrate 301 (step 12). The portion is a non-wired area. In the present invention, the first electrode 307 is an anode or a cathode and the substrate 301 is one of a silicon wafer substrate, a glass substrate, a metal substrate, a plastic substrate, or a color filter substrate, etc.

A second electrode 304 is moved to be above and not in contact with the substrate 301 (step 13). The second electrode 304 has a polarity opposite to that of the first electrode 307. In one example, the second electrode 304 is a sheet like electrode which is assembled above the substrate 301 at an approximately horizontal position. In the present invention, when the substrate 301 is a color filter substrate for electro deposition), the second electrode 304 is a cathode. In the present invention, the second electrode 304 is a non-resolved electrode which do not react in electroplating or electro deposition (using in conductive organic material). When in the electro deposition of a color filtering substrate or a conductive photo resistor, the second electrode 304 is a non-resolved cathode which do not react in electroplate reaction.

Then, electroplating liquid 305 is filled into the enclosure formed by the stop plates 306 so as to be in contact with the second electrode 304 above the substrate 301 for electroplating or electro deposition. In the present invention, the electroplating liquid 305 (or electro deposition liquid) is filled into the enclosure slowly. That, some of the electroplating liquid (or electro deposition liquid) flows into the enclosure and some electroplating liquid (or electro deposition liquid) flow out of the enclosure so that the electroplating liquid is turbulent and thus the ions can be uniformly electroplated (or coating) upon a surface of the substrate 301. The speed of the electroplating liquid (or electro deposition liquid) filled into the enclosure is controllable. Thus, a uniform thin film is formed on the substrate 301. The electroplating liquid 305 flowing out of the enclosure can be received in a reuse system 303 below the substrate 301. The electroplating liquid is reused through the processes of filtering and adjustment of density. Thus the cost is down.

FIG. 3 shows the second embodiment of the present invention, wherein the second electrode 308 is movable so that the electroplate and electro deposition are formed part by part.

Figure 4A:
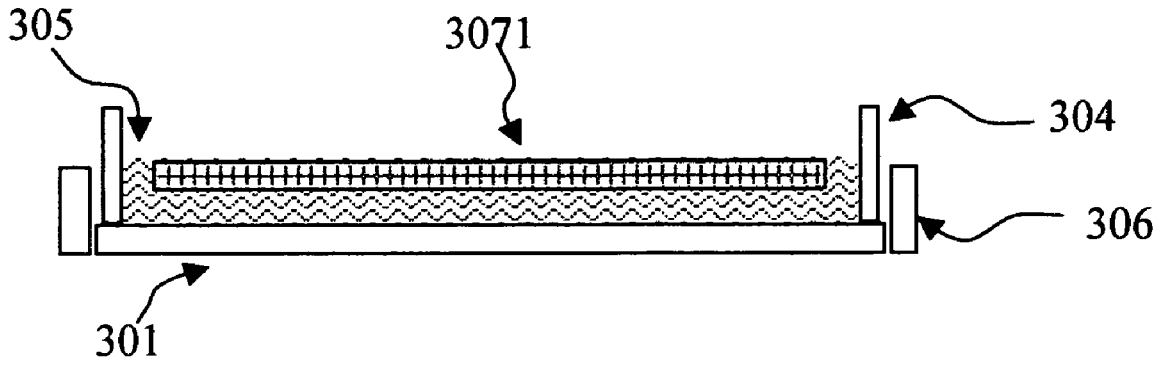
FIGS. 4A and 4B show the second electrodes of the present invention which have different forms.
Figure 4B:
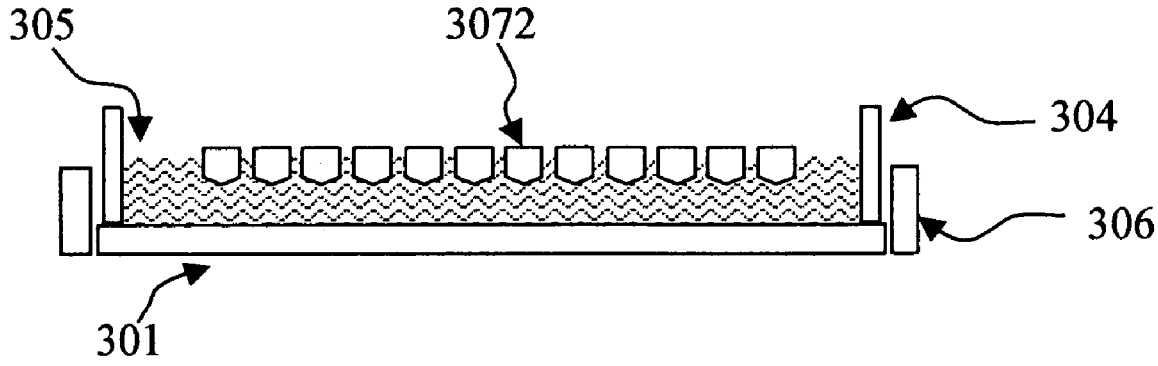

Referring to FIGS. 4A and 4B, the third embodiment of the present invention is illustrated. In the following those identical to the former embodiment will not be described herein. Only those difference are described. In this embodiment, the first electrode 307 is a netlike electrode (referring to FIG. 4A) or is formed by a plurality of cylinders (referring to FIG. 4B). However all these are within the scope of the present invention.

Figure 5:
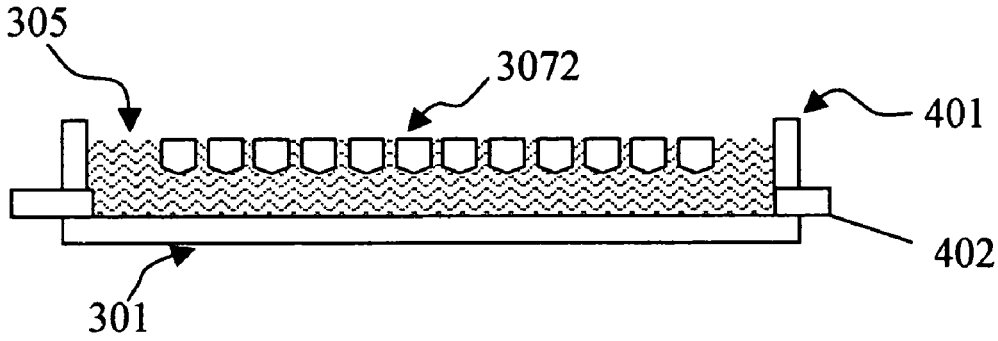
FIG. 5 shows a different arrangement of the first electrode and the enclosure according to the present invention.

FIG. 5 shows the fourth embodiment of the present invention. In the following those identical to the former embodiment will not be described herein. Only those difference are described. In this embodiment, the first electrodes 402 are assembled below the stop plates 401 and are in contact with the substrate 301. Similarly, the first electrode 402 may be a net-like electrode or is formed by a plurality of cylinders.

Figure 6:
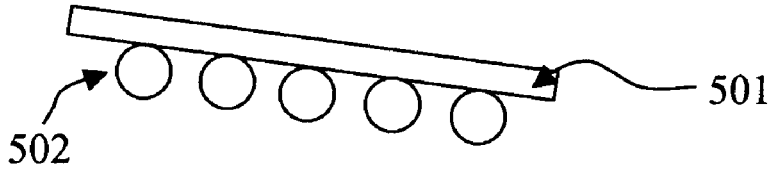
FIG. 6 is a schematic view where it is illustrated that the substrate supporter is tiltable and the substrate supporter is formed by a plurality of rollers.

FIG. 6 shows the fifth embodiment of the present invention. In the following those identical to the former embodiment will not be described herein. Only those difference are described. In this embodiment, the rollers 502 is tiltable so as to adjust the density of the electroplating layer upon the substrate and thus to have a more uniform electroplating layer.

Figure 7:
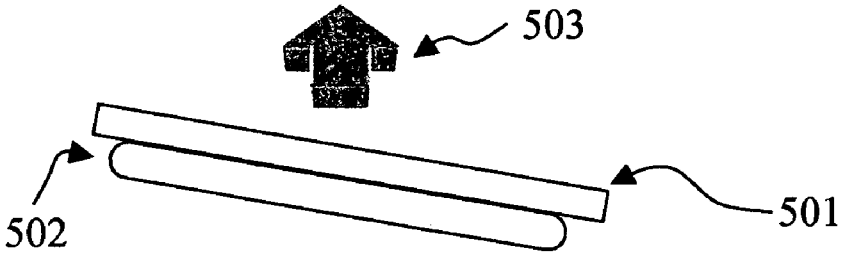
FIG. 7 is a schematic view where it is illustrated that the substrate supporter is tiltable and the substrate supporter is formed by a stage.

Referring to FIG. 7, the sixth embodiment of the present invention is illustrated. In the following those identical to the former embodiment will not be described herein. Only those difference are described. In this embodiment, the substrate supporter 502 is a stage 502. Similarly, the stage 502 is tiltable for adjusting the density of the electroplating layer upon the substrate and thus to have a more uniform electroplating layer.

Figure 8:
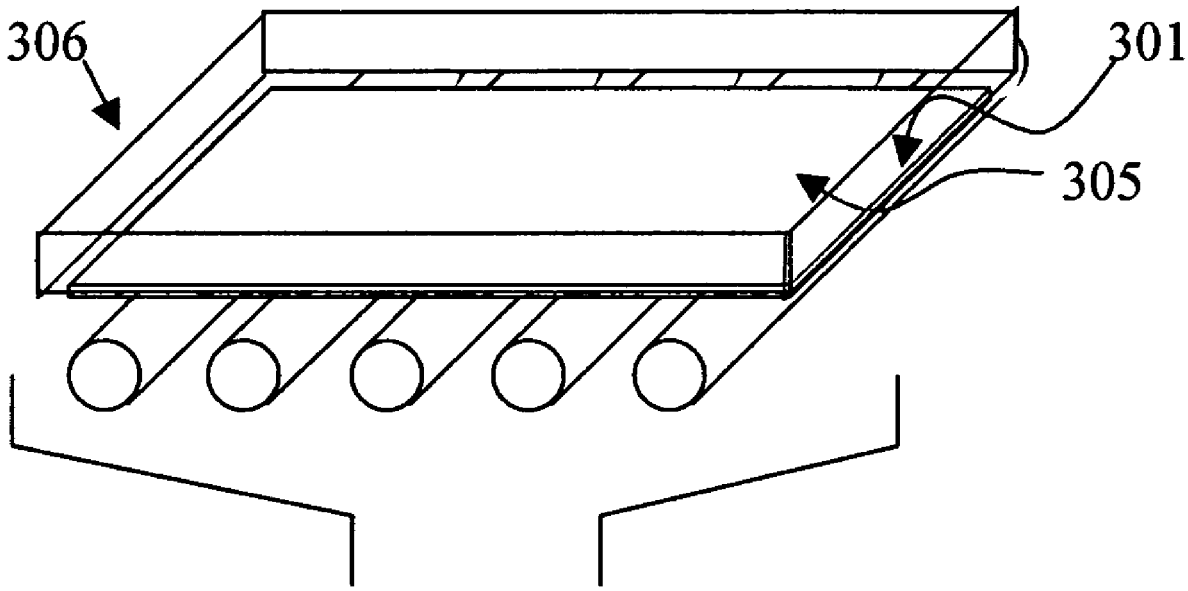
FIG. 8 shows that the present invention is used to an electroless-plating process.

FIG. 8 shows the seventh embodiment of the present invention. In the following those identical to the former embodiment will not be described herein. Only those difference are described. It is illustrated that the present invention can be used in an electroless plate process. In the process for filling liquid, a substrate activation liquid is filled into the enclosure for activating the substrate. Then an electroless plate liquid is filled into the enclosure to be in contact with the substrate 301 so as to perform electroless plate process. Furthermore, the activating liquid and the electroless plate liquid can be received by the reuse system.

Furthermore, in the present invention, all the elements can be moved synchronously.

In the present invention, the substrate 301 can be electroplated or electro deposited on one surface or two surfaces or a panel plating can be performed to the substrate 301.

Furthermore, in the present invention, a conductive thin film can be deposited upon the substrate firstly for defining a pattern for electroplating or electro deposition.

In the present invention, the first electrode and second electrode may be an electrode formed by semi-permeable material enclosing the electroplating liquid or electro deposition liquid.

In the present invention, a parameter control system for electroplating liquid, electro deposition liquid, or electroless-plating liquid is included for controlling and analyzing the PH value, temperature, cyclic voltages sequence (CVS), electric charge distribution, conductivities, and particle diameters, of the liquid so as to appear the conditions of the process.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for horizontally electroplating or electro deposition a thin film on a substrate, comprising the steps of:

transferring and positioning a substrate on a substrate supporter; the substrate being positioned approximately horizontally;

moving a plurality of stop plates to enclose horizontal edges of the substrate so as to form with an enclosure around the edges of the substrate;

moving a first electrode to be in contact with a portion of the substrate; the portion being a non-wired area;

moving a second electrode to be above and not in contact with the substrate; wherein the second electrode has a polarity opposite to that of the first electrode; and filling electroplating liquid into the enclosure formed by the stop plates so as to be in contact with the second electrode above the substrate for electroplating or electro deposition;

wherein the stop plates enclose a peripheral of the substrate; and the supporter, the substrate, the stop plates, the first electrode, the second electrode and the electroplating liquid are movable synchronously.

2. The method of claim 1, wherein some of the electroplating liquid slowly flows into the enclosure and some electroplating liquid flow out of the enclosure slowly.

3. The method of claim 2, wherein the electroplating liquid flowing out of the enclosure is received in a reuse system below the substrate.

4. The method of claim 1, wherein the substrate supporter is one of a plurality of roller and a stage.

5. The method of claim 1, wherein the second electrode is a sheet like electrode which is assembled above the substrate at an approximately horizontal position.

6. The method of claim 1, wherein the substrate is selected from a group consisting of a silicon wafer substrate, a glass substrate, a metal substrate, a plastic substrate, a color filter substrate, and a conductive substrate.

7. The method of claim 1, wherein a conductive thin film is deposited upon the substrate by coating, electroless-plating or sputtering.

8. The method of claim 1, wherein the first electrode is one of a netlike substrate and a plurality of posts.

9. The method of claim 1, wherein a distance between the second electrode and the substrate is adjustable.

10. The method of claim 1, wherein the second electrode is a non-resolved electrode which does not react in electroplating or electro deposition or is a resolved anode formed by a metal to be electroplated or electro deposited.

11. The method of claim 1, wherein the first electrode and second electrode is an electrode formed by semi-permeable material enclosing the electroplating liquid or electro deposition liquid.

12. The method of claim 1, wherein a conductive thin film is deposited upon the substrate firstly for defining a pattern for electroplating or electro deposition.

13. The method of claim 1, wherein the material for electroplating and electro deposition is one of copper, silver, aluminum, metals, conductive pigments, dyes, and conductive gelatin.

14. The method of claim 1, wherein the stop plates have one of oblong shapes and round cylindrical shapes.

15. The method of claim 1, wherein the substrate supporter is tiltable for adjusting the liquid for electroplating or electro deposition.

16. The method of claim 1, wherein a parameter control system for electroplating liquid, electro deposition liquid, or electroless-plating liquid is included for controlling and analyzing the PH value, temperature, cyclic voltages, electric charge distribution, conductivities, and particle diameters, of the liquid.

17. The method of claim 1, wherein the first electrode is horizontally arranged below the stop plates and is in contact with the substrate.

18. The method of claim 1, wherein the substrate is transferred to the substrate supporter by using a plurality of rollers or a robot arm.

* * * * *